US011476031B1

(12) United States Patent
Farahani

(10) Patent No.: US 11,476,031 B1
(45) Date of Patent: Oct. 18, 2022

(54) CURRENT ADAPTIVE REACTOR STRUCTURE

(71) Applicant: Smart Wires Inc., Union City, CA (US)

(72) Inventor: Ali Farahani, Yorba Linda, CA (US)

(73) Assignee: Smart Wires Inc., Union City, CA (US)

( * ) Notice: Subject to any disclaimer, the term of this patent is extended or adjusted under 35 U.S.C. 154(b) by 848 days.

(21) Appl. No.: 16/155,638

(22) Filed: Oct. 9, 2018

Related U.S. Application Data

(60) Provisional application No. 62/713,290, filed on Aug. 1, 2018.

(51) Int. Cl.

| | |
|---|---|
| ***H01F 27/08*** | (2006.01) |
| ***H01F 27/22*** | (2006.01) |
| ***H01F 27/00*** | (2006.01) |
| ***H01F 27/28*** | (2006.01) |
| ***H01F 27/24*** | (2006.01) |

(52) U.S. Cl.
CPC ..... *H01F 27/22* (2013.01); *H01F 27/004* (2013.01); *H01F 27/24* (2013.01); *H01F 27/2823* (2013.01); *H01F 27/2876* (2013.01)

(58) Field of Classification Search
CPC ..... H01F 27/22
USPC ..... 336/61
See application file for complete search history.

(56) References Cited

U.S. PATENT DOCUMENTS

| | | | | |
|---|---|---|---|---|
| 3,671,847 | A * | 6/1972 | Shibano | H05B 6/687 331/86 |
| 3,747,205 | A | 7/1973 | Moore | |
| 6,919,788 | B2 | 7/2005 | Holdahl et al. | |
| 7,105,952 | B2 | 9/2006 | Divan et al. | |
| 9,172,246 | B2 | 10/2015 | Ramsay et al. | |
| 2003/0197583 | A1* | 10/2003 | Choi | H05B 6/662 336/58 |
| 2004/0061584 | A1* | 4/2004 | Darmann | H01F 6/06 336/182 |
| 2012/0299680 | A1 | 11/2012 | Zajc | |
| 2012/0299686 | A1* | 11/2012 | Matsuda | H01F 27/34 336/212 |
| 2013/0241686 | A1* | 9/2013 | Nakatsu | H01F 41/0246 336/212 |
| 2014/0132380 | A1* | 5/2014 | Jacobson | H01F 27/2876 336/60 |
| 2017/0163036 | A1 | 6/2017 | Munguia et al. | |

OTHER PUBLICATIONS

English translation of GB2037089 (Year: 1980).*

(Continued)

*Primary Examiner* — Ronald Hinson
(74) *Attorney, Agent, or Firm* — Womble Bond Dickinson (US) LLP

(57) ABSTRACT

A transformer for power line reactance injection that can be adapted in manufacturing to different operating current ranges by interchanging primary windings having one, two, three, four or more laminar turns. Through its use of gaps in the magnetic circuit that are filled with high temperature, high thermal conductivity dielectrics, this transformer has tolerance to very high fault currents, and it can be passively cooled by the use of fins on the exterior walls of the core.

9 Claims, 10 Drawing Sheets

(56) References Cited

OTHER PUBLICATIONS

Minhaz, Ronnie, "Transformer Design & Design Parameters", IEEE Green Mountain Chapter of the IEEE Power Engineering Society, Dec. 1, 2014, 56 pp. total.
Smart Wires Inc., "Power Guardian 700 Data Sheet", Feb. 8, 2018, 2 pp. total.

* cited by examiner

CURRENT ADAPTIVE REACTOR STRUCTURE

CROSS-REFERENCE TO RELATED APPLICATIONS

This application claims the benefit of U.S. Provisional Patent Application No. 62/713,290 filed Aug. 1, 2018, the entirety of which is incorporated herein by reference.

BACKGROUND OF THE INVENTION

1. Field of the Invention

The present invention generally relates to power transmission systems and, more particularly to equipment used to address phase imbalances associated with power transmission systems.

2. Prior Art

High capacity electric power transmission systems using alternating current typically operate with three phases, using a three-wire system for transmission. (This discussion will focus on three phases even though more than three may be used in unusual circumstances.) Nominally, each of the three wires has a voltage and current waveform that is 120° leading or lagging relative to its two companions, and each wire is carrying the same RMS current. In the real world, the desired balance of the currents in the three wires does not come easily, usually because of imbalances in load conditions, but imbalance may also occur because of reactive differences among the three wires supporting the transmission system or from imbalances among distributed power sources. A very practical consequence of poor balance among the three phases is a loss of system capacity because the high current line reaches its limit while its companions are underloaded. In contemporary power networks, the balance among phases can be monitored, simulated and corrected by inserting either inductive or capacitive reactance into selected phases.

In many cases, there are transmission paths that are essentially parallel, but because of local conditions, one of two or more parallel paths may tend to operate at or beyond its capacity while the alternative paths are underloaded. Again, the overall system capacity is increased when inductive or capacitive reactance is introduced into the transmission paths.

In all the cases above, inserting reactance can be accomplished without switches. Two examples are U.S. Pat. No. 7,105,952, "Distributed floating series active impendences for power transmission systems," by Divan et al. and U.S. Pat. No. 9,172,246, "Phase balancing of power transmission system," by Ramsay, et al. Both of these schemes utilize the transmission line itself as a "single-turn" primary of a transformer that is completed by hollow, cylindrical ferromagnetic core and a secondary wrapped around the core. The core and secondary are split so they can be clamped on the transmission line, the primary, using a clam shell arrangement. The injected reactance is managed by controlling the current flow in the secondary of the transformer.

In practice, equipment of this type is exposed to the elements, and a typical ambient temperature rating is 50° C. Under operating conditions, resistive losses in the windings and hysteresis and eddy current losses in the ferromagnetic core of the transformer give rise to heating. This heating is exacerbated in overload and fault conditions, and hot spot heat rises may reach 150° C.

This invention addresses an alternative design for the transformer to be used for coupling to the transmission line.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION OF THE PREFERRED EMBODIMENTS

Figure 1:
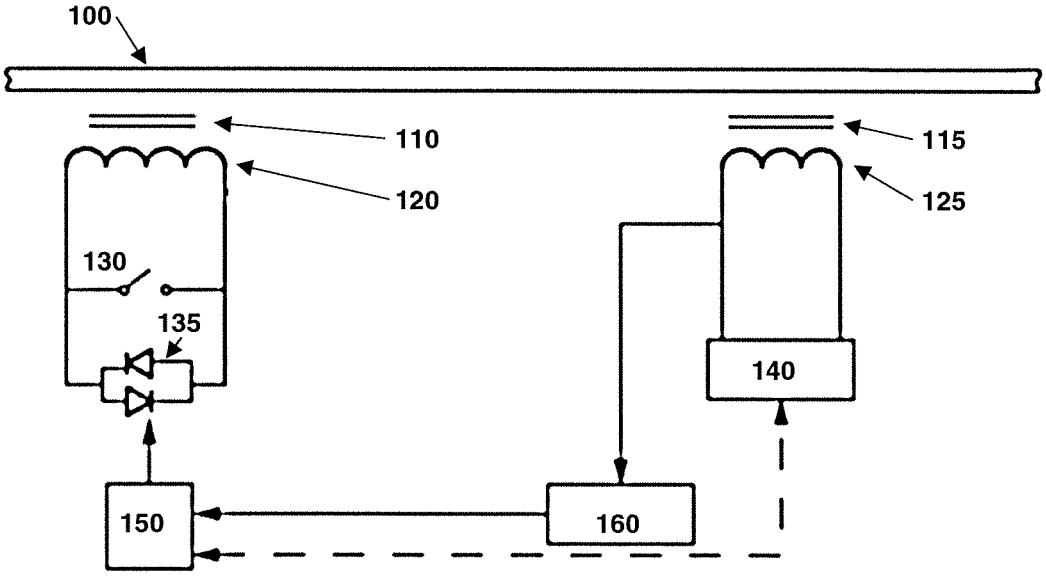
Fig. 1 (Prior Art)
FIG. 1 shows a schematic block diagram of a distributed series reactor based on using the power transmission line as the primary of a reactor transformer. This is prior art.
Figure 2:
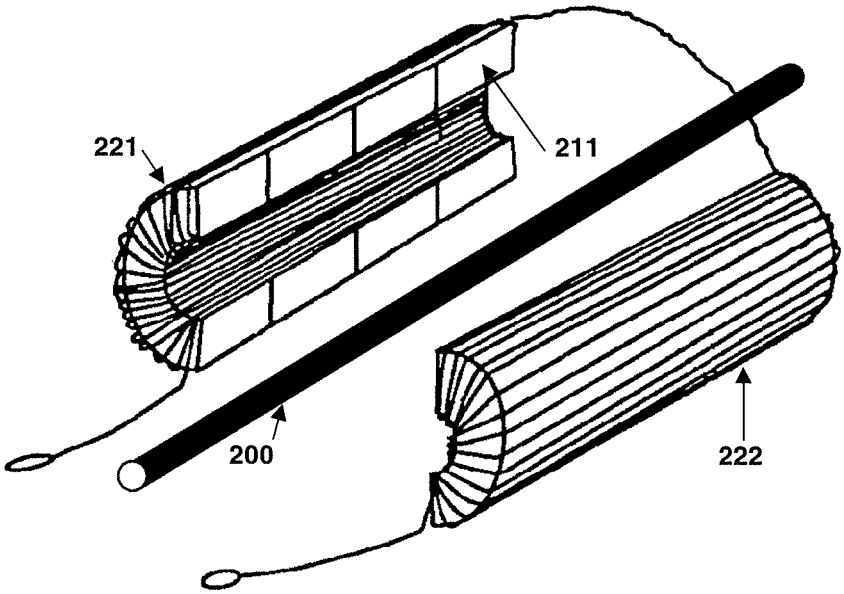
Fig. 2 (Prior Art)
FIG. 2 shows a diagrammatic representation of a reactor transformer coupling to a power transmission line. This is prior art.

The use of transformers to actively inject series reactance into a transmission line is well established. FIG. 1 shows a schematic block diagram of a distributed series reactor as described in U.S. Pat. No. 9,172,246. The transmission line 100 acts as primary winding for the principal reactance transformer formed by the additional elements, a secondary winding 120 and a ferromagnetic core 110. The contactor 130 and a back-to-back pair of thyristors or silicon controlled rectifiers 135 bridge the secondary and control the reactance injected into the transmission line 100. These bridging devices 130 and 135 also provide protection under fault conditions, when excessive currents may pass through the transmission line 100. The switches 130 and 135 are managed by a controller 150, which receives its power from the power supply 140. The supporting transformer composed of primary 100, core 115 and secondary 125 provides power to the electronics, and it also allows the current monitor 160 to measure the operating status of the transmission line 100. In U.S. Pat. No. 9,172,246 and in U.S. Pat. No. 7,105,952, the transformer core is a long hollow cylinder, and as shown in FIG. 2, it is split in half. Element 211 in FIG. 2 is half a core, and that core half is wrapped with the secondary winding 221, and there is a matching core and secondary 222. Those two transformer secondary halves 221 and 222 encase the transmission line 200 like a clamshell to realize a complete transformer.

Figure 3:
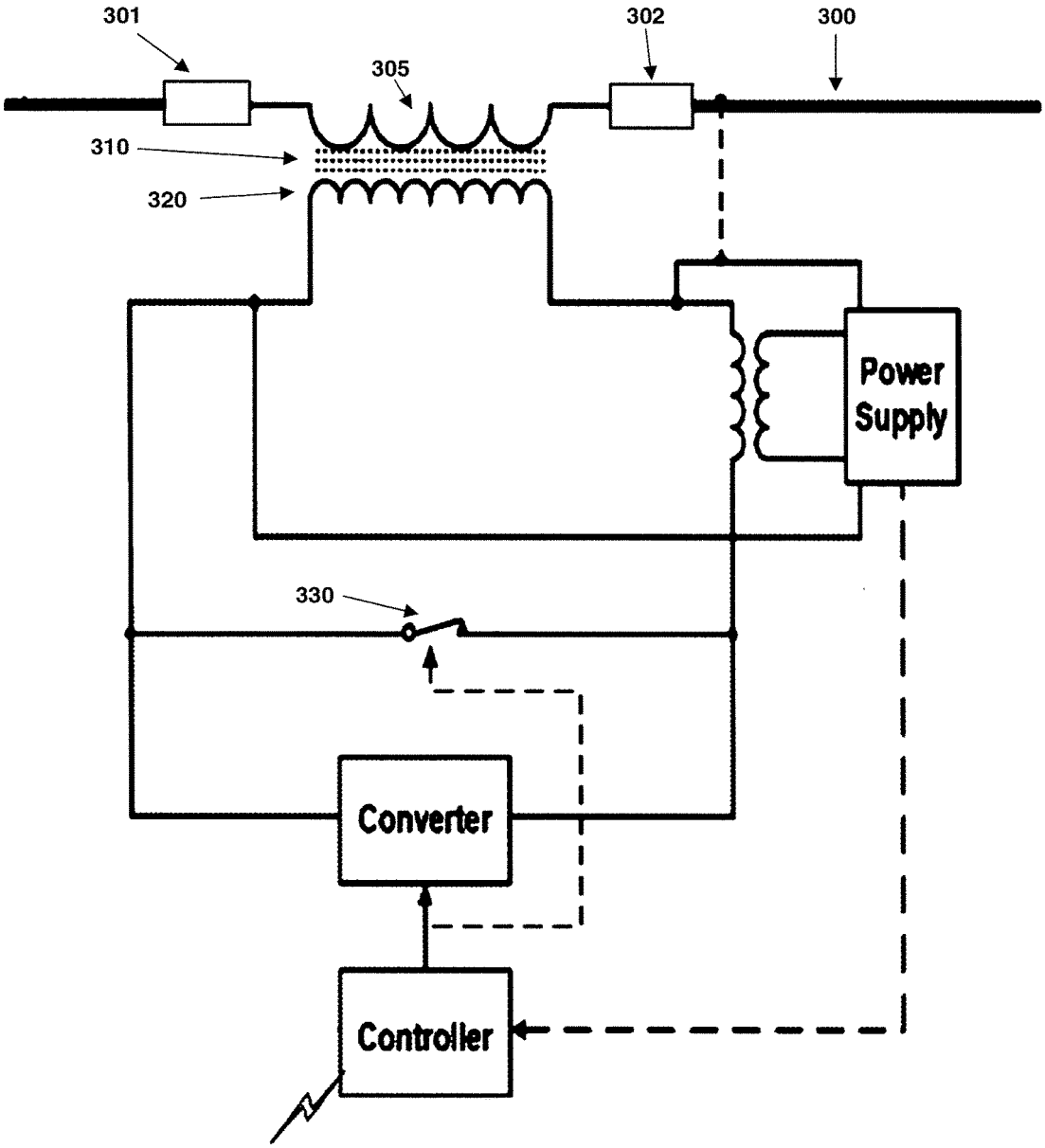
Fig. 3 (Prior Art)
FIG. 3 shows as schematic block diagram of an active impedance injecting module using a reactor transformer having a multi-turn primary. This is prior art.

Similarly, the application of Munguia et al. US 2017/0163036 (Transformers with multi-turn primary windings for dynamic power flow control) addresses the case where an impedance injection module is more favorably realized using a principal transformer with a multi-turn primary, element 305 in FIG. 3. This primary is introduced in series with the transmission line 300 by connectors 301 and 302. In US 2017/0163036, the transformer core 310 is a hollow ferromagnetic cylinder, wrapped with both the primary 305 and the secondary 320. The supporting electronics in this case are slightly different from those in U.S. Pat. No. 9,172,246.

In the work described above, transformers are based on cylindrical ferromagnetic cores, which makes the transformers difficult to manufacture. The paragraphs that follow will describe a transformer structure for power line reactance injection that is readily adapted to a wide range of operating currents, offers superior cooling under operating conditions, tolerates high fault currents, and offers manufacturing advantages when a range of products must be produced.

Figure 4:
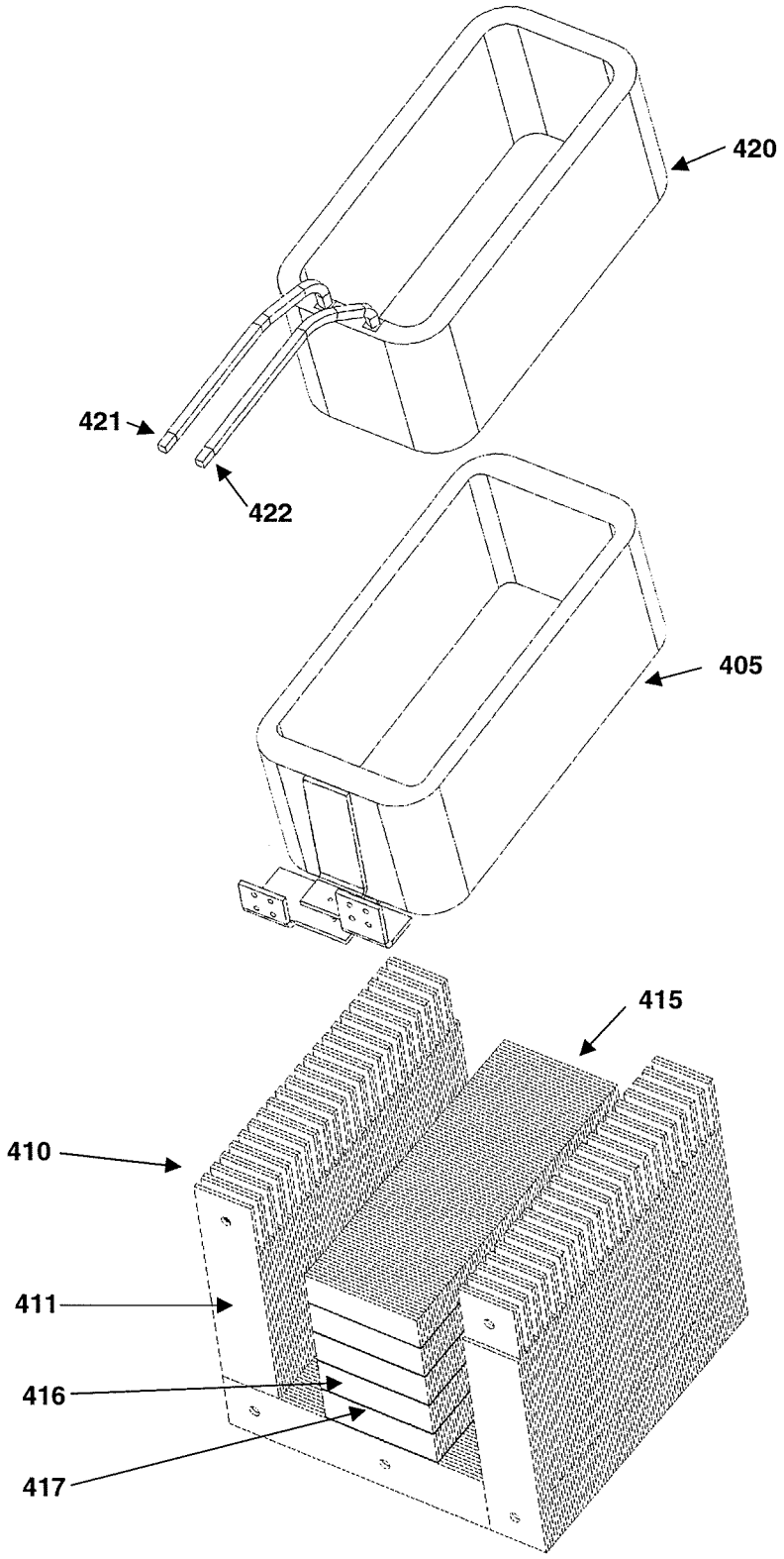
FIG. 4 shows an exploded assembly diagram of the disclosed transformer structure.

The basic structure for a current adaptive reactor transformer is shown in FIG. 4, an exploded diagram of the principal components of the transformer. The bottom part of the transformer's rectangular core 410 is shown at the bottom. For clarity the top of the rectangular core has been omitted from the diagram. The bottom has an "E" shape, with top and sides formed from laminated, rectangular leaves 411 of ferromagnetic material, insulated to preclude eddy currents. The center post 415 is also composed of leaves 416, but structured so that there are multiple (non-magnetic) gaps 417 in the magnetic circuit. The primary winding 405 is configured to fit within the sides of the core 415, leaving room for the secondary 420. The secondary winding 420 is sized to fit within the primary winding 405 while fitting around the center post 415 of the core. The secondary terminals 421 and 422 are accessed from the top of the structure. The secondary winding 420 may be formed from wire, braid or conductive ribbon, or preferably by windings utilizing the continuously transposed conductor (CTC) configuration, as exemplified in U.S. Pat. No. 3,747,205 ("Method of constructing a continuously transposed transformer coil," by Harold R. Moore). While FIG. 4 shows a single secondary winding, specific configurations may incorporate two or more secondary windings. Additional secondary windings may be used to harvest operating power, to monitor line currents or other functions as required.

Figure 5A:
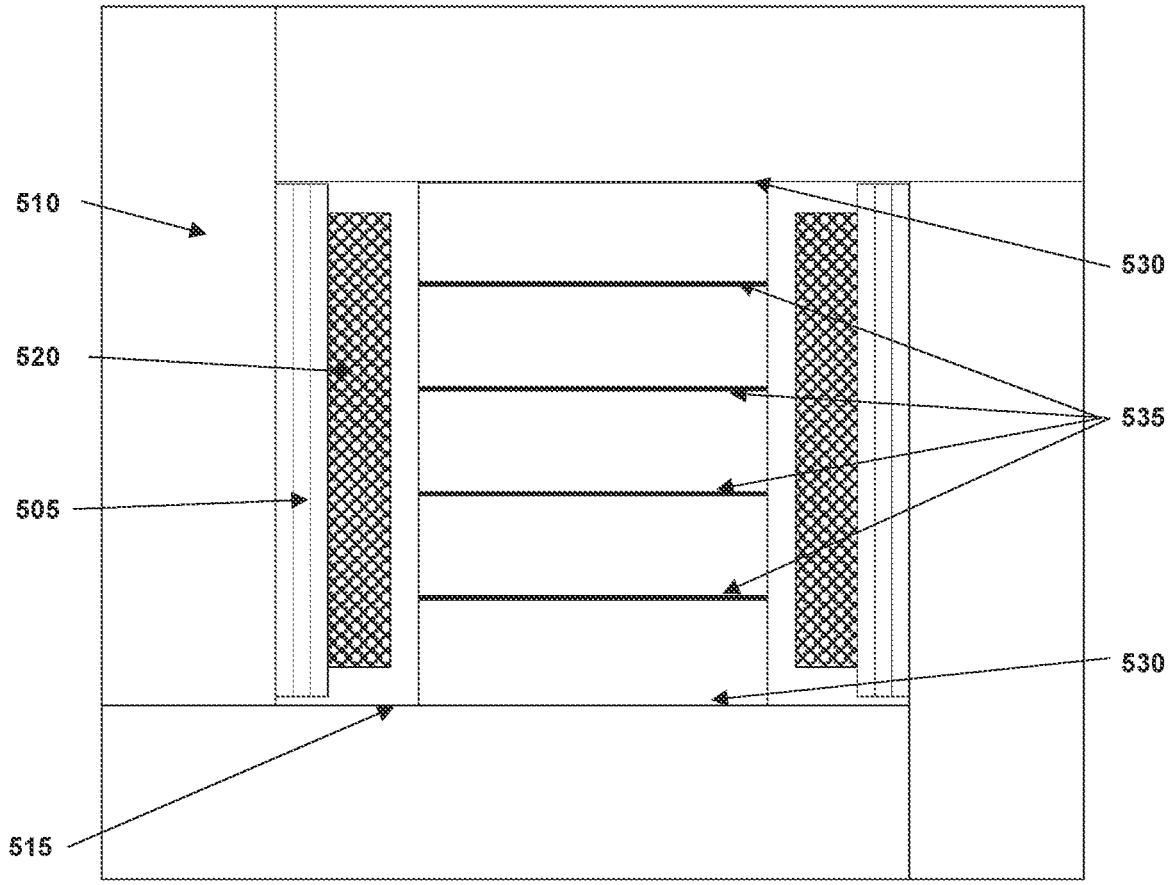
FIG. 5A shows a cross section of the disclosed transformer structure.
Figure 5B:
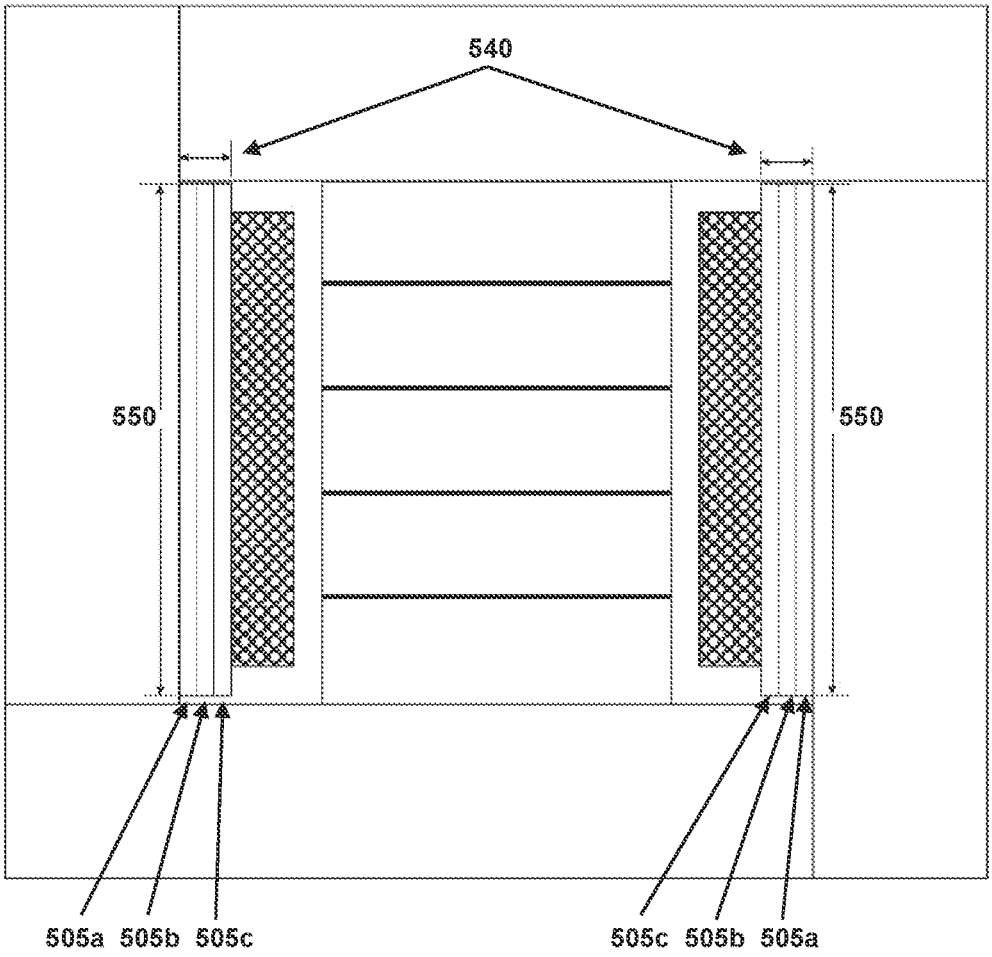

FIG. 5B shows a cross section of an example transformer structure having a primary winding of three laminar turns.

Figure 5C:
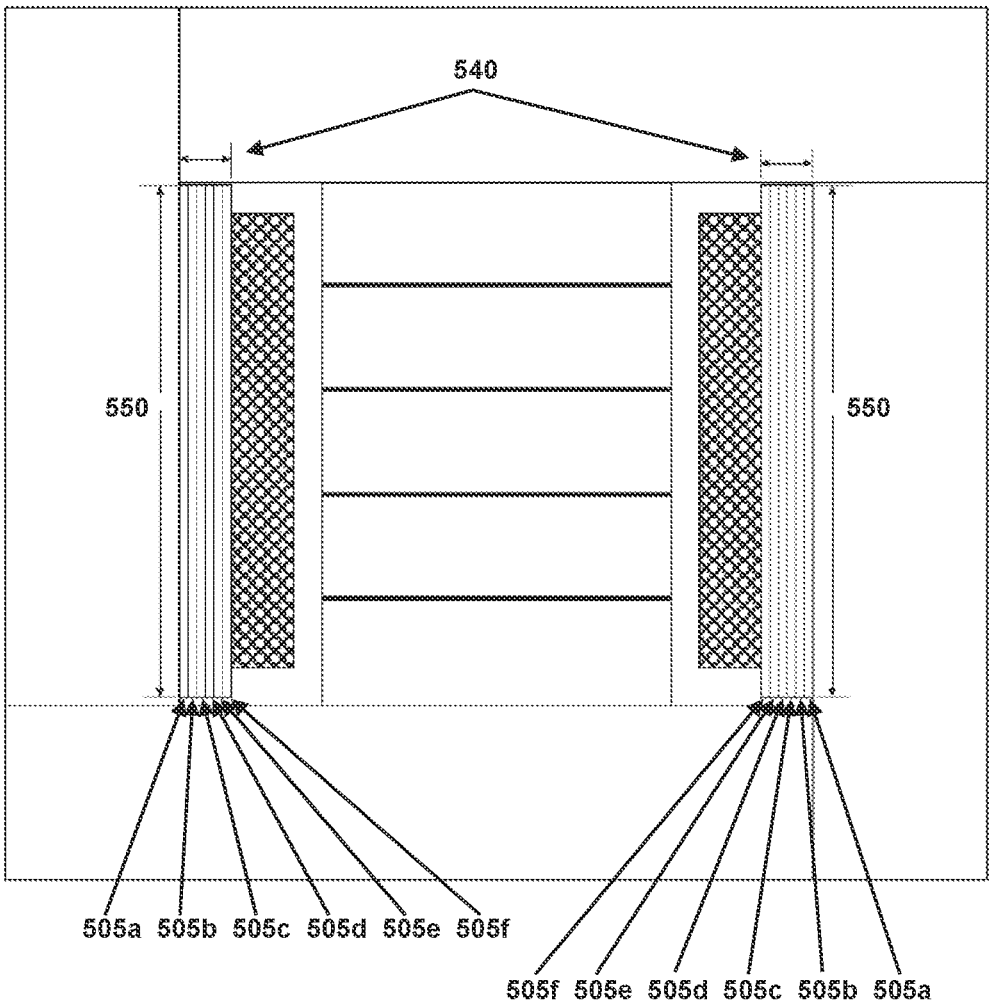

FIG. 5C shows a cross section of an example transformer structure having a primary winding of six laminar turns.

The center post 515 of the rectangular core 510 has multiple gaps 530 and 535 in the magnetic circuit to avoid saturation in the operating current range and to manage the total inductance seen by the primary. Traditionally, these gaps are regarded as "air gaps," but here the gaps are filled with materials chosen for their dielectric and mechanical strength, high temperature tolerance, and especially for high thermal conductivity. Specific examples of materials that may be used to fill the gaps 530 and 535 are ceramics (high-purity alumina or beryllium oxide), thin borosilicate glass (e.g. Borofloat), papers made of aramid with inorganic fillers (e.g. ThermaVolt AR, which is useable to 220° C.), and high temperature glass composites. These materials assist in cooling the transformer under operating conditions and increase the tolerance to high fault currents. If the gaps were filled with air, absent convection, the thermal conductivity κ in the gaps would be low, approximately 0.03 watt/mK°. An air gap of 750 μm having an area of 1000 square centimeters would sustain a temperature difference of 250° K if it were passing 1000 watts of heat. Filling that gap with an aramid (e.g. Nomex) with κ near 0.1 watt/mK° would reduce the temperature difference to about 75° K. Filled aramid would bring the temperature difference to about 20° K, borosilicate glass to less than 7° K, and alumina (κ~35 watt/mK°) would bring the temperature difference to about 0.21° K. Table 1 below provides thermal conductivities and temperature differences for air and a number of possible fillers for the gaps. Preferably the thermal conductivity of any material used for filing the gaps is at least 0.2 watt/(mK°), and more preferably at least in excess of 20 W/(mK°).

TABLE 1

| | Power watts | Thickness mm | K watt/(mK°) | Width cm | Length cm | AT K° |
|---|---|---|---|---|---|---|
| Still Air | 1000 | 0.75 | 0.03 | 20 | 50 | 250 |
| Nomex | 1000 | 0.75 | 0.1 | 20 | 50 | 75 |
| ThermaVolt AR[1] | 1000 | 0.75 | 0.23 | 20 | 50 | 32.6 |
| ThermaVoit AR[2] | 1000 | 0.75 | 0.4 | 20 | 50 | 18.8 |
| Borosilicate glass | 1000 | 0.75 | 1.1 | 20 | 50 | 6.8 |
| Alumina | 1000 | 0.75 | 35 | 20 | 50 | 0.21 |

[1]ThermaVolt AR thermal conductivity reported for a thickness of 0.29 mm.
[2]ThermaVolt AR thermal conductivity extrapolated to a thickness of 0.75 mm.

Thermal and magnetic design considerations may require different materials at the ends 530 of the center post than are used in the intermediate gaps 535. In every case, the employment of structurally rigid materials in the gaps 530 and 535 enhance the transformer's ability to withstand high fault currents.

Looking at the completed structure in cross section in FIG. 5A, the sequence of elements becomes clearer. The center post 515 of the rectangular core 510 is within the windings. The secondary winding 520 is positioned external to the center post 515. The primary winding 505 is external to the secondary winding 520. Thus, the primary winding 505 has an external dimension that fits within the outer legs of the rectangular core 510, and the internal dimension of the primary 505 has to accommodate the secondary winding 520, which is positioned between the primary winding 505 and the center post 515.

FIG. 5B shows a cross section of an example transformer structure having a primary winding of three laminar turns 505*a*, 505*b* and 505*c*. As shown, laminar turns 505*a*, 505*b* and 505*c* of the primary winding (e.g., primary winding 505) collectively have a total thickness 540, meaning that each of the turns has a thickness of one-third the total thickness 540. The primary winding also has a height 550.

FIG. 5C shows a cross section of an example transformer structure having a primary winding of six laminar turns 505*a*, 505*b*, 505*c*, 505*d*, 505*e* and 505*f*. As in FIG. 5B, the total thickness 540 of the primary winding in FIG. 5C is a constant across the family of transformers, and in FIG. 5C each laminar turn has a thickness of one-sixth of the total thickness 540, resulting an operating current carrying capacity half that of FIG. 5B. The primary winding of FIG. 5C also has a height 550. The total thickness 540 multiplied by the height 550 is the total conducting cross-section area A of the winding. Since the winding is laminar, the cross-section area of any layer of the winding is A/N, where N is the number of layers (or laminar turns) in the winding. The current carrying capacity is proportional to the cross-section area of a layer or a laminar turn in the winding. Keeping thickness 540 and height 550 constant across the family of transformers assures simple construction of units having different operating currents employing interchangeable primaries.

Figure 6:
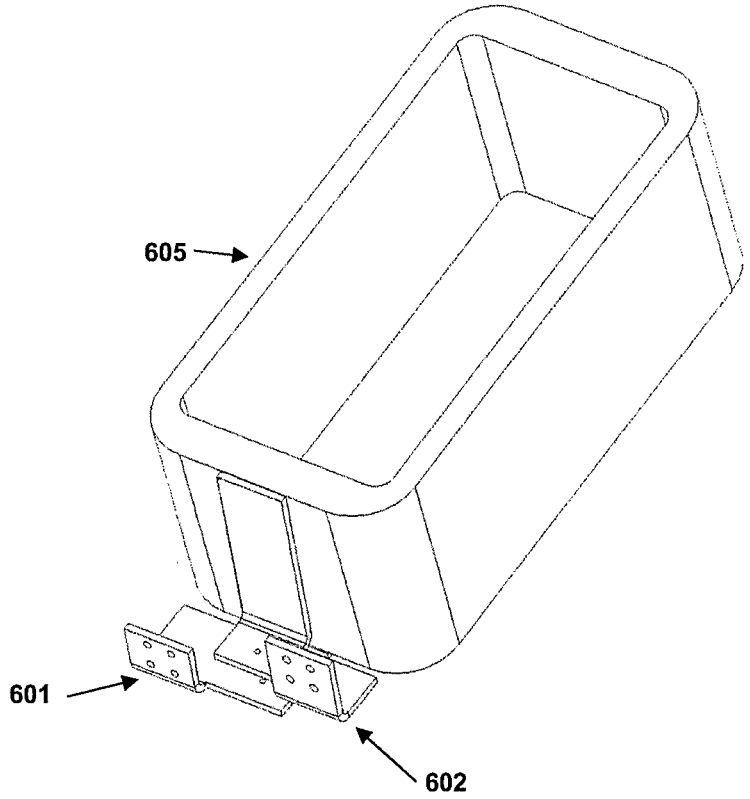
FIG. 6 shows the primary winding apart from the other elements of the transformer.

FIG. 6 shows a sketch of the primary winding 605 of the transformer. The winding of the transformer is terminated by tabs 601 and 602, which are connected to the powerline using conductive, mechanical connections that are not shown in the figure.

Figure 7A:
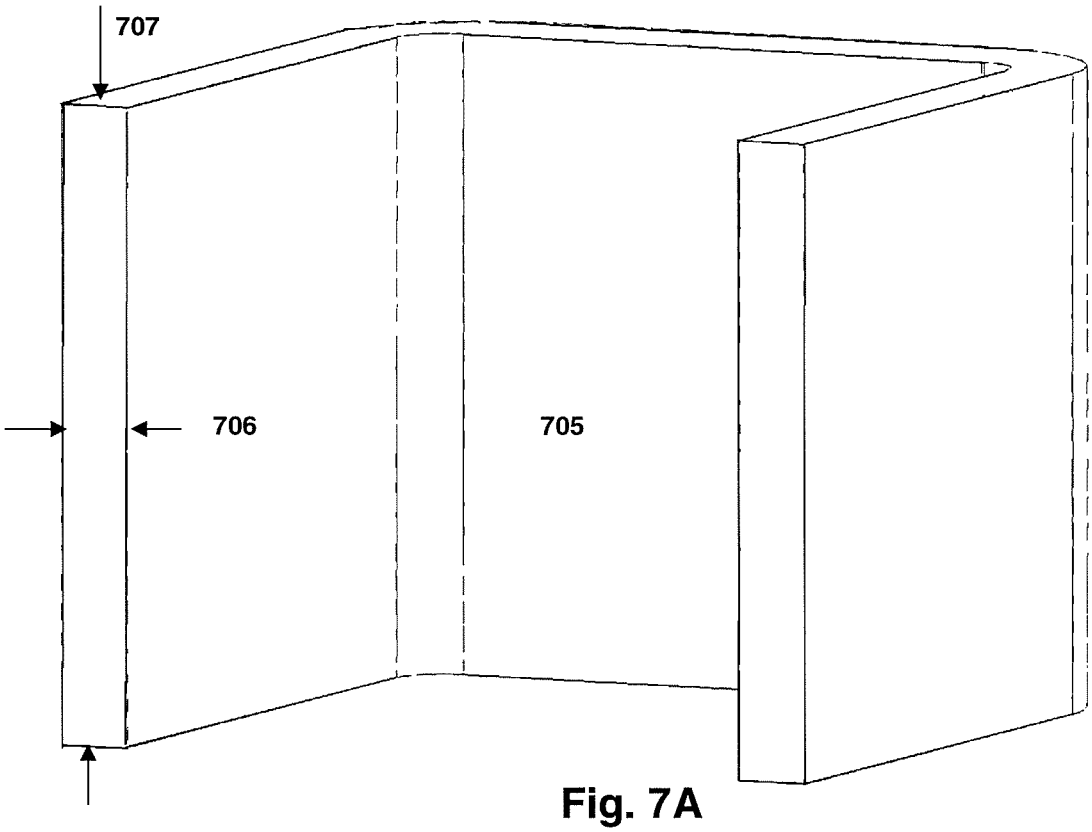
FIG. 7A is a partial section diagram of a primary having a single laminar turn.

As illustrated by FIG. 7A, depicting half of primary winding 705, the cross section of the primary winding 705, with insulation, is rectangular, neglecting any rounded edges on the sheet-like or strip-like conductor and likely on the insulated conductor, with a small dimension 706 and a longer dimension 707. In that regard, the word rectangular in the context of the laminar turns as used in the claims to follow is used in accordance with the foregoing definition of rectangular. For convenience, the longer dimension 707 will be called "height," and the smaller dimension will be called "thickness." To accommodate the maximum possible current, the primary winding 705 could be configured as a single laminar turn. For instance, if the cross section were 100 square cm, as it would be if dimension 706, the thickness, were 3.33 cm and dimension 707, the height, were 30 cm, a primary current of 9,600 A would imply a current density of 96 A/cm$^2$ in the single laminar turn.

Figure 7B:
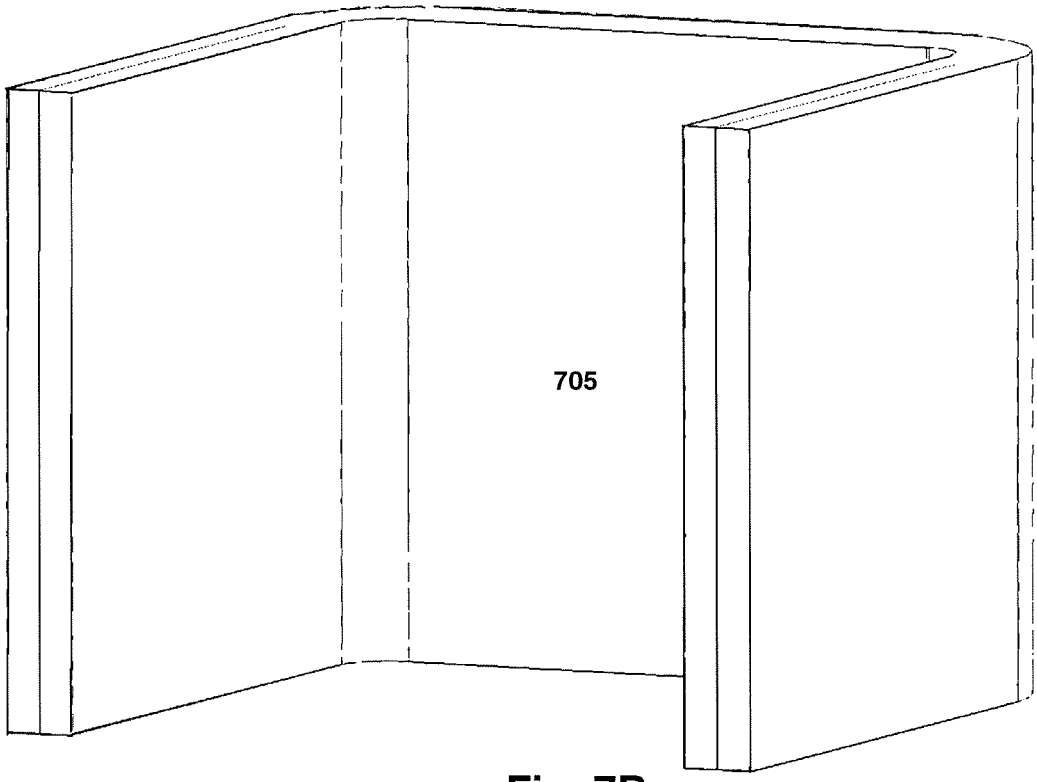
FIG. 7B is a partial section diagram of a primary having two laminar turns.

The primary 705 is configured in FIG. 7B, showing half of the primary winding with two laminar turns occupying the same cross section area, making the primary interchangeable with that in FIG. 7A. With the operating current at 96 A/cm$^2$ would imply an operating current of 4800 A. Like an ordinary transformer, each additional turn of the laminar turns is merely a continuation of the prior laminar turn.

Figure 7C:
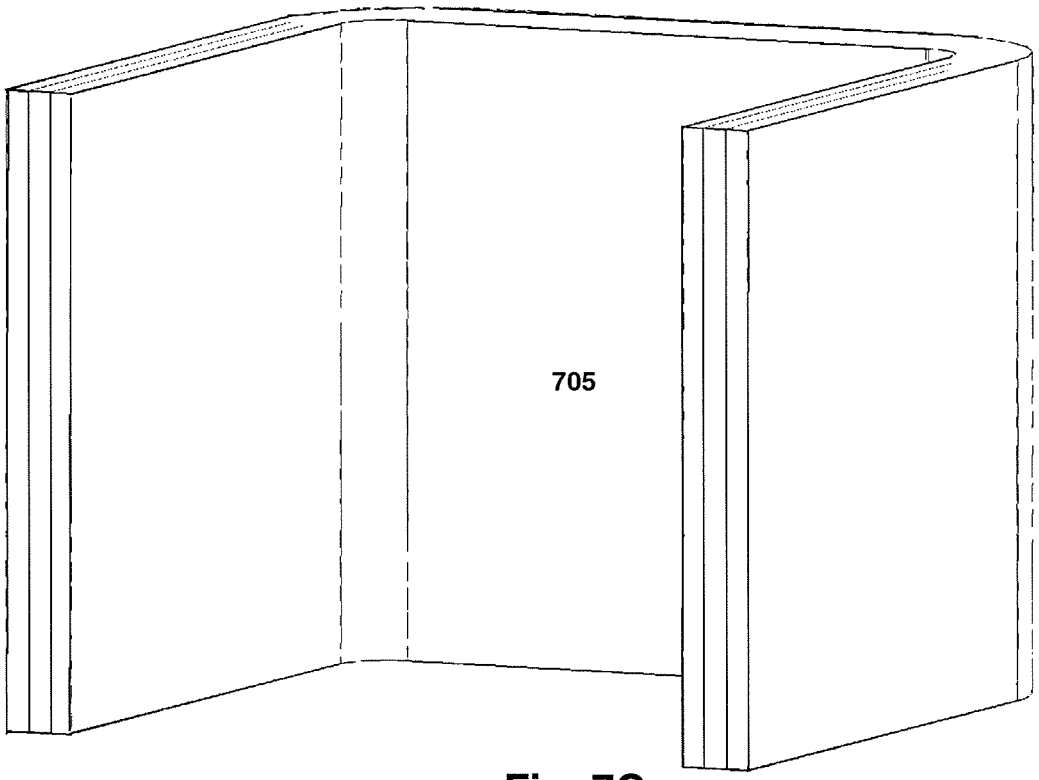
FIG. 7C is partial section diagram of a primary having three laminar turns.
Figure 7D:
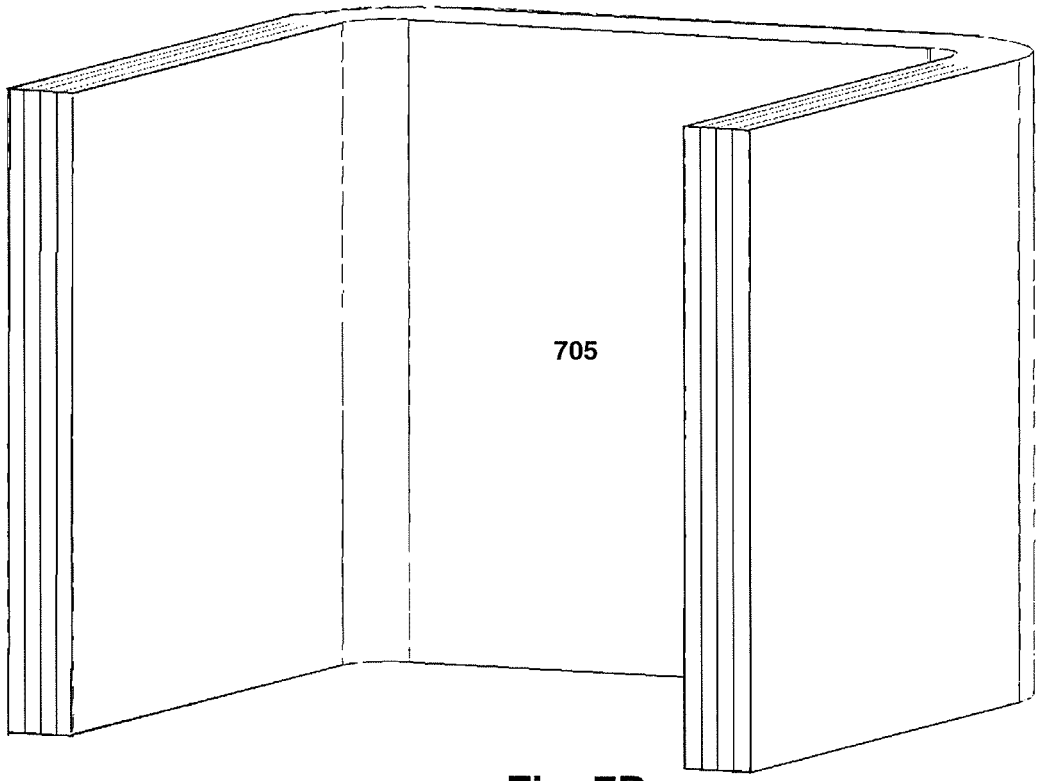
FIG. 7D is a partial section diagram of a primary having four laminar turns.

While one and two laminar turns are illustrative, preferred embodiments utilize at least three laminar turns. A three-laminar turn primary 705 as illustrated in FIG. 7C would have an operating current of 3200 A at 96 A/cm$^2$, and a four-laminar turn primary 705 as illustrated in FIG. 7D would have an operating current of 2400 A at 96 A/cm$^2$. In each of the illustrated cases the primary laminar turns are layers, having the common height 707 of the primary.

Logically, this configuration can be extended beyond three or four laminar turns to N laminar turns, and each of the laminar turns would be confined to have a thickness of 1/N times the total thickness of the primary. With a common height, the current carrying capacity would scale downward by the factor 1/N. In other words, the interchangeability of primaries having different current ratings is assured by having constant total cross sections, for example thickness 540 and height 550 shown in FIGS. 5B-5C. With this constraint, the total conducting thickness is the sum of the thicknesses of the N conducting laminae, and that sum is constrained to be a constant across the family of different primary current ratings.

The interchangeable primaries 705 as illustrated in FIGS. 7A, 7B, 7C and 7D all have equivalent ampere-turn products. This equivalence enables the preparation of a Distributed Series Reactor or other power line reactance injection system in which the secondary winding 120 in FIG. 1 or 320 in FIG. 3, as well as the center post 515 with gap spacers such as gap spacers 530 and 535 may remain unchanged and still operate over scaled ranges of operating currents. A similar argument may be made for the support and control electronics 140, 150 and 160 in FIG. 1.

The current density of 96 A/cm$^2$ used above is illustrative, and nominal current densities larger or smaller may be employed. Minor deviations from precise duplication of the cross-sections may be tolerated as long as interchangeability is maintained across the family of transformers.

TABLE 2

| Primary Turns | Maximum Continuous Operating Current (RMS) | Injected Inductance in μH (At Max Operating Current) | Fault Current Rating kA (RMS) for ½ second |
|---|---|---|---|
| 3 | 3200 | 112 | 63 |
| 6 | 1600 | 450 | 63 |
| 9 | 1067 | 1012 | 49 |
| 12 | 800 | 1799 | 37 |

Table 2 above shows representative characteristics for a family of transformer configurations illustrated by FIG. 7C and extensions to larger numbers of laminar turns. The operating currents scale from 3200 A RMS down to 800 A RMS, but the fault currents are constant for the smaller numbers of laminar turns, reflecting the total thermal mass of the rectangular core and windings. For larger numbers of laminar turns, fault currents decrease because excessive electromagnetic forces. All fault current ratings are valid with the protective contactors 130 in FIGS. 1 and 330 in FIG. 3 closed. While Table 2 extends to 12 laminar turns, higher numbers of laminar turns may also be used. In that regard, one of the advantages of the present invention is that it allows the manufacture and at least partial assembly of nearly entire impedance injection modules, (sidewalls and center post of the magnetic rectangular core with spacers, and with secondary, the rest of the module including its control and enclosure, etc.) which then can be characterized for maximum continuous operating current and completed when needed in a short calendar time without requiring the maintenance of a huge inventory of large pluralities of injection modules of differing maximum operating current.

Figure 8:
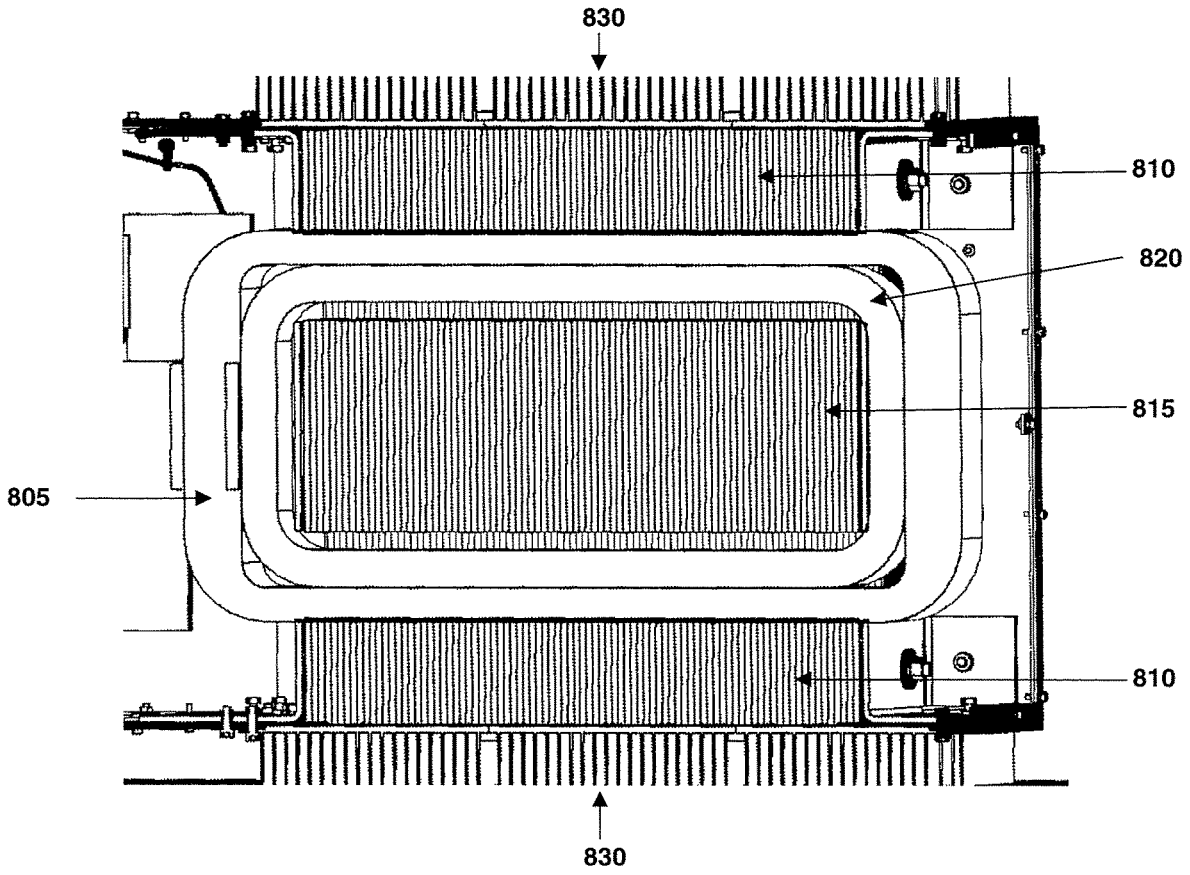
FIG. 8 is a cross-section diagram of an assembled reactor transformer having fins for enhanced cooling.

In every high current application, heating is a consideration. The thermal characteristics of the described transformer are dominated by the rectangular core 510 in FIG. 5. Its thermal characteristics are enhanced by the inclusion of gap spacers 530 and 535 having high thermal conductance in the center post 515. The relatively high thermal conductance of the ferromagnetic leaves making up the rectangular core allows heat to be passed from the center, including the center post 515 to the sides of the transformer rectangular core 510. In FIG. 8, the transformer rectangular core is shown in a cross section perpendicular to that shown in FIG. 5. The primary winding is identified as 805 and the secondary winding is 820. The center post of the rectangular core is identified as 815, and the sidewalls of the rectangular core are identified as 810. Taking advantage of the thermal conductivity of the rectangular core 810 and 815, the cooling of the entire reactance injection system is enhanced by attaching fins 830 to at least one side or preferably two or more sides of the enclosure for the transformer immediately adjacent the transformer rectangular core 510, preferably oriented so as to be aligned vertically when the reactance injection system is deployed for use. These fins 830 enable passive convection cooling of the entire reactance injection system, and most directly of the transformer core by way of heat generated within the transformer and conducted from the transformer core through the immediately adjacent wall of the enclosure having the fins thereon.

Even though the invention disclosed is described using specific implementation, it is intended only to be exemplary and non-limiting. The practitioners of the art will be able to understand and modify the same based on new innovations and concepts, as they are made available. The invention is intended to encompass these modifications.

What is claimed is:

1. A system, comprising:

a plurality of transformers for use in a power line reactance injection system, each transformer comprising:

a laminated ferromagnetic core having a laminated ferromagnetic center post;

one or more secondary windings surrounding the laminated ferromagnetic center post; and a primary winding surrounding the one or more secondary windings;

wherein the primary winding includes N laminar turns of conductors, each laminar turn having a height and a thickness;

wherein a total conducting cross section of the primary winding is N times a thickness of a laminar turn times a height of the laminar turn, and the total conducting cross section of the primary winding is a constant; and wherein N is a positive integer.

2. The system of claim 1 wherein for each transformer, the primary winding is rectangular in cross section and has a specified height and a specified width configured to fit within the laminated ferromagnetic core and to be external to the one or more secondary windings.

3. The system in claim 1 wherein for each transformer, a primary operating current of the transformer is inversely proportional to the number N of laminar turns of the primary winding of the transformer.

4. The system of claim 1 wherein the respective primary windings of the transformers include different number of laminar turns from one another, thereby resulting in the transformers having different primary operating currents from one another.

5. The system of claim 1 wherein for each transformer, the laminated ferromagnetic core is a rectangular laminated ferromagnetic core having sidewalls, wherein the center post is separated from the sidewalls by gaps at each end of the center post, the gaps being filled with alumina, borosilicate glass, papers made of aramid with inorganic fillers, or glass composites having thermal conductivities in excess of 0.2 W/(mK°).

6. The system of claim 1 further comprising a plurality of enclosures, wherein each transformer is disposed within an enclosure, the enclosure having cooling fins on at least one external surface of the enclosure and being adjacent to at least one sidewall of the laminated ferromagnetic core for passive convection cooling of the laminated ferromagnetic core.

7. The system of claim 1 wherein for each transformer, the laminated ferromagnetic center post of the laminated ferromagnetic core has a plurality of gaps in a magnetic circuit defined by the laminated ferromagnetic core and the laminated ferromagnetic center post.

8. The system of claim 7 wherein the gaps in the laminated ferromagnetic center post are filled with dielectric materials having thermal conductivities in excess of 0.1 watt/(mK°).

9. The system of claim 7 wherein the gaps in the laminated ferromagnetic center post are filled with alumina, borosilicate glass, papers made of aramid with inorganic fillers, or high temperature glass composites useable to temperatures of at least 220° C.

* * * * *